United States Patent [19]

Gottlieb

[11] Patent Number: 4,951,430

[45] Date of Patent: Aug. 28, 1990

[54] REMOVABLE GUTTER AND FASTENER SYSTEM

[76] Inventor: David Gottlieb, P.O. Box 1170, Scarsdale, N.Y. 10583

[21] Appl. No.: 405,522

[22] Filed: Sep. 11, 1989

[51] Int. Cl.[5] ..... E04D 13/00

[52] U.S. Cl. ..... 52/11; 52/16; 248/48.1; 248/48.2

[58] Field of Search ..... 52/11, 15, 16; 248/48.1, 48.2

[56] References Cited

U.S. PATENT DOCUMENTS

| | | | |
|---|---|---|---|
| 190,382 | 5/1877 | Snyder | 52/11 X |
| 2,899,157 | 8/1959 | Wolfe | 248/48.1 |
| 3,550,381 | 12/1970 | South | 248/48.2 X |
| 3,612,453 | 10/1971 | Zimmer | 248/48.2 |
| 4,190,988 | 3/1980 | Carreiro | 52/11 X |
| 4,300,319 | 11/1981 | Frost et al. | 248/48.1 X |
| 4,632,342 | 12/1986 | Skinner | 248/48.2 |

*Primary Examiner*—David A. Scherbel
*Assistant Examiner*—Linda J. Hoffert
*Attorney, Agent, or Firm*—Kenyon & Kenyon

[57] ABSTRACT

The present invention relates to a novel removable, yet secure, gutter and fastener system. More particularly, the invention relates to elongated roof gutter sections which include a bottom member and a front wall and a rear wall attached lengthwise along the member's opposite edges thereby forming a channel. The gutter sections further include an overhanging lip consisting of the bottom member and protruding away from the channel at either end of the channel. The elongated roof gutter sections are removably mounted using a hook and slot, or an interlocking flange system to an elongated fastener member which, in turn, is mounted along the roof line of a building.

8 Claims, 4 Drawing Sheets

REMOVABLE GUTTER AND FASTENER SYSTEM

The present invention relates to the field of roof gutter assemblies and, more particularly, to a novel removable, yet secure, gutter and fastener system.

BACKGROUND OF THE INVENTION

Roof gutters have been in use for many years. Their principal function now, as it has been in the past, is to catch the rain water descending off of a roof surface and funnel it away from the foundation of the supporting house structure. The funneling of the water away from the house foundation prevents the water from closely compacting the surrounding soil, undermining the foundation itself, and eventually seeping into and through the foundation walls.

In the past, various gutter systems have been designed and implemented by manufacturers. The most often used gutter system is a permanent type system which employs long spiked nails to attach the gutter to the edge of a roof truss. The elongated gutter system is pitched downward to channel the falling water into a downward spout which, in turn, leads the falling water down and away from the house.

The permanent type gutter system has a number of inherent problems associated with it. It tends to damage the roof edge fascia where it is attached and it is difficult to replace when the gutters rot, become damaged, or are otherwise unusable. Most importantly, as is explained in detail below, it is very hard to clean and keep free of accumulated debris.

As is clear to any homeowner, all objects which fall onto the roof of a house eventually become channeled into and lodged in that house's gutter system. Such objects include leaves, tree limbs, toys, and various other airborne objects. As these objects accumulate in the gutter system, they eventually block the flow of water for which the gutters were originally designed. Many times the blocked gutters even conduct water into the house itself along the fascia of the roof eave.

This problem is exacerbated in the northern climates where every fall brings a cascade of thousands of falling leaves which accumulate in the gutters; once temperatures have fallen below freezing, the accumulated debris soaked with water freezes, overweights the gutter structure and makes the gutter system wholly useless for its purpose and even dangerous to persons passing underneath.

The only solution to the above gutter problem is the frequent cleaning and removal of collected debris. Since these gutters are generally irremovable, house owners must climb up to the level of the gutter itself. While balancing on a ladder, a home owner must reach into a tight opening and remove the accumulated debris. Once the owner has removed the debris, he or she generally must let it fall to the ground level where it must still be swept into piles and disposed of. It is clear why many house owners find the chore distasteful.

A number of improvements have been suggested to the often used permanent gutter system. For example, separable gutter and hanger arrangements have been designed which allow for the removal of the gutter from its position around the roof line. While this arrangement facilitates easier cleaning of the gutter, these systems have had problems of their own. They are generally in a single piece which is difficult to remove and, once removed, difficult to clean and reinstall. Also the removable gutter and hanger systems of the past have tended to come apart easily during violent weather.

Furthermore, previous removable gutter and hanger systems have been found to leak between their seams, and have, in other ways, been impractical due to their expense. For example, some systems which were slideably mounted tended to become obstructed by small twigs and other foreign matter while being susceptible to rust and freeze up during winter thereby making removal very onerous.

SUMMARY OF THE INVENTION

It is therefore an object of this invention to provide for a well constructed, inexpensive, and, because it is in short sections, an easily removable gutter and fastener system.

It is a further object of this invention to provide for a gutter and fastener system whose longevity would be improved due to its ease of removal, cleaning, and reinstallation allowing for more frequent and easier on-the-ground cleaning by a homeowner with a hose.

It is still a further object of this invention to provide for a removable gutter and fastener system which could be easily installed to replace a traditional permanent gutter system.

It is also a further object of this invention to provide for a removable gutter and fastener system which, due to its secure fastener configuration, would keep its structural integrity even during violent weather.

It is another object of this invention to provide for a removable gutter and fastener system which would not leak as it conducted water along its length.

It is yet another object of this invention to provide for a removable gutter and fastener system which could be easily adapted for various types of roofs and lengths therefor.

It is still another object of this invention to provide for a gutter and fastener system which would add value to any house it was installed on and thereby become a feature that could be positively promoted by a builder or the owner.

The objects of this invention are accomplished by providing an elongated roof gutter section including a bottom member with a front wall and a rear wall attached lengthwise along the member's opposite edges thereby forming a channel. The channel includes a lip at either end consisting of an extension of the bottom member and protruding away from the channel. The rear wall includes one or more hooks mounted on its backside. An elongated fastener strip is in turn mounted along the roof line of a building. This elongated fastener strip includes one or more slots which can securely, yet releasably, fasten the hooks mounted on the backside of the channel's rear wall.

An alternative to the hook and slot method of mounting would be the use of a dovetail flange. The elongated fastener strip would include a shaped flange and the gutter section would include a similarly shaped, yet reversed flange that would securely, yet releasably, connect with the shaped flange of the elongated fastener strip. The gutter section herein would also include an overhanging lip protruding from either side of the channel.

DETAILED DESCRIPTION OF THE INVENTION

Figure 1:
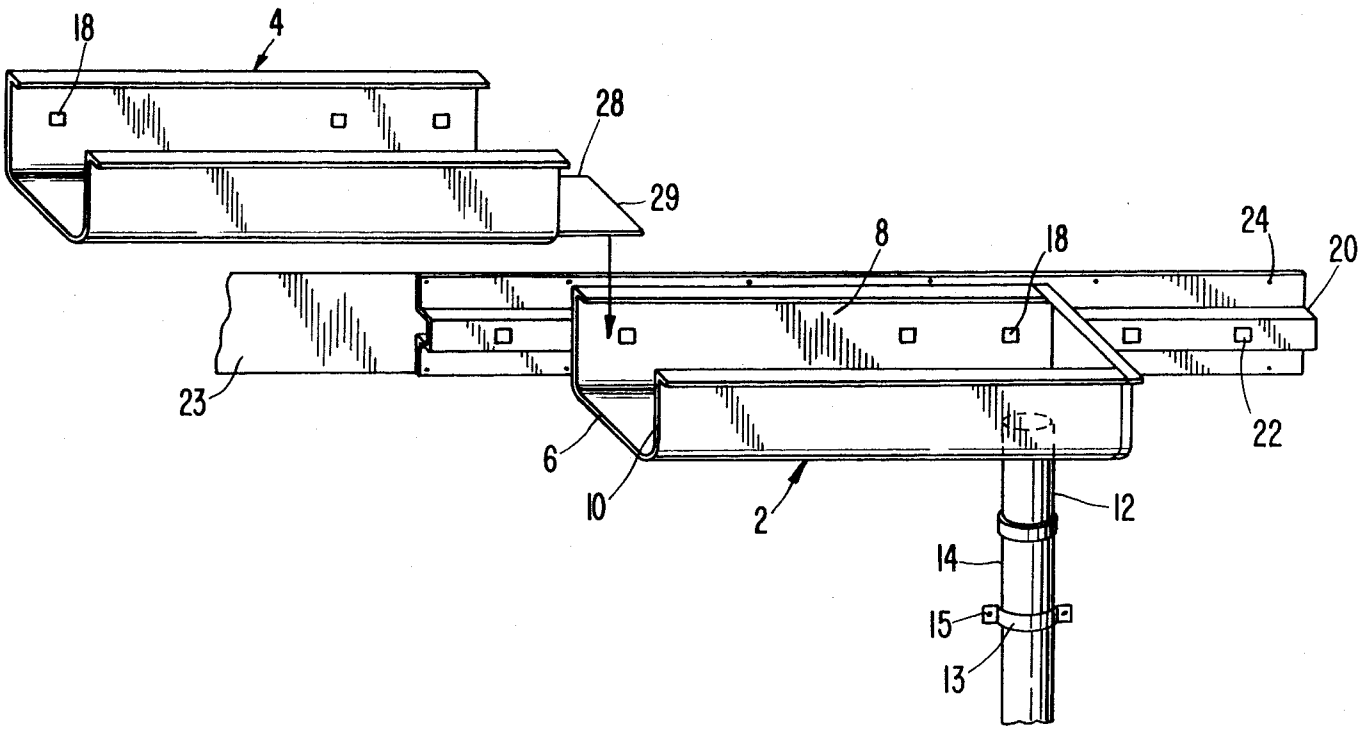
FIG. 1 is a schematic diagram showing the hook and slot embodiment of the removable gutter and fastener system as disclosed by the present invention.

Referring specifically to the drawings, FIG. 1 illustrates one embodiment of the present invention. With reference to FIG. 1, two gutter sections, 2 and 4, of the gutter and fastener system are shown. Gutter section 2 includes a bottom member 6, rear wall 8, and front wall 10. As shown in FIG. 1, the front wall 10 and rear wall 8 are attached lengthwise along the bottom member's 6 opposite edges and together they form the gutter channel. Section 2 of the gutter and fastener system shown includes a leader 12 which leads to downspout 14.

Figure 2:
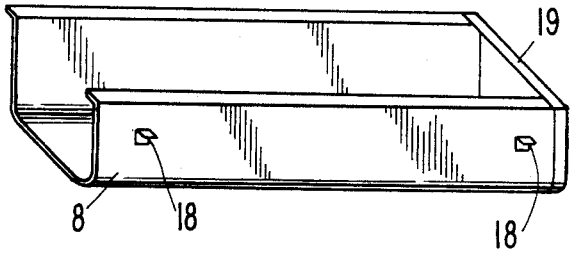
FIG. 2 is a schematic diagram of the back side of an end gutter section for use with the hook and slot method of removable attachment as disclosed by the present invention.
Figure 3:
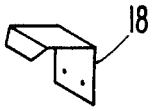
FIG. 3 is a schematic diagram of the hook shown in FIG. 2.

As shown in FIGS. 1 and 2, the back of the gutter section's 2 rear wall 8 includes hooks 18 which can be either part of the actual gutter, if nonmetallic materials are used, or, if the materials used are metallic, are secured thereto using an attachment method such as welding. Further in FIG. 1, an elongated fastener strip 20 is shown which includes slots 22 which are designed to securely, yet releasably, receive and hold hooks 18. A more detailed version of hook 18 is shown in FIG. 3.

Figure 4:
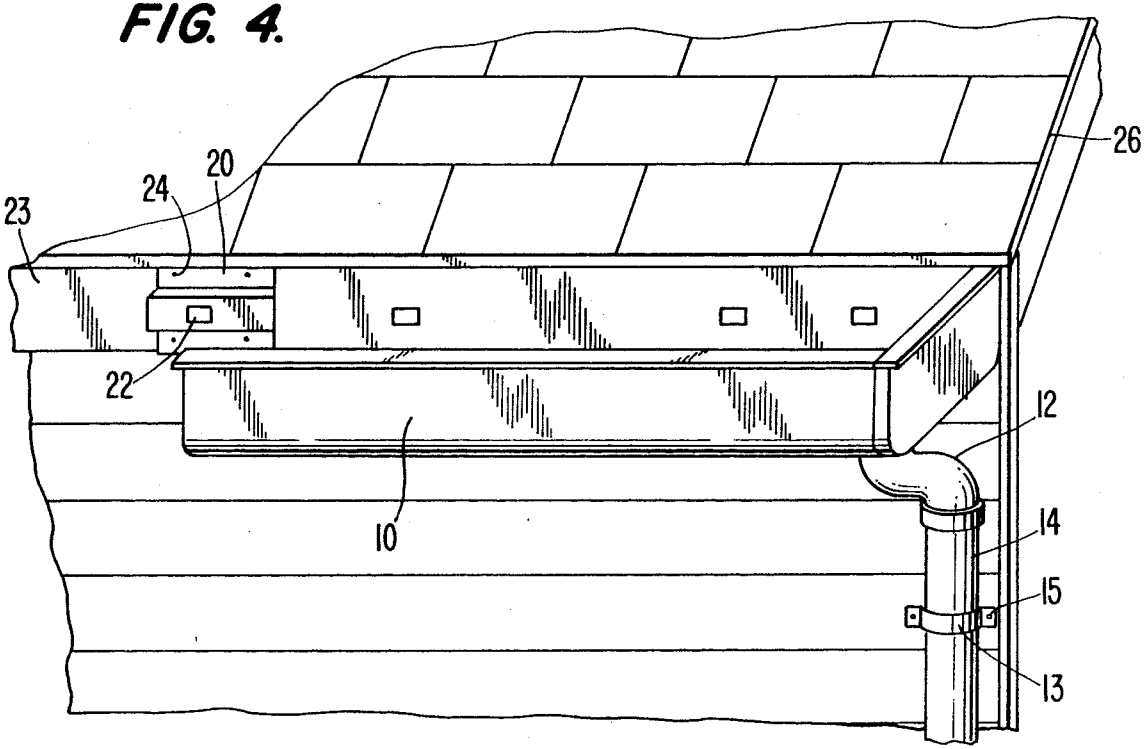
FIG. 4 is a schematic diagram showing the gutter and fastener system of FIG. 1 as attached to a house roof structure.

As shown in FIGS. 1 and 4, elongated fastener strip 20 is permanently attached to roof fascia 23. The elongated fastener strip 20 could be attached with glue, screws, or another means but the preferred attaching means herein is nailing through holes 24. This allows for easy and inexpensive installation. The elongated fastener strip 20 is attached in a sloping fashion along the roof fascia roof line of roof 26 so that the later attached gutter sections will be able to easily conduct the flow of water to downspout 14. The elongated fastener strip 20 is generally about three inches high and cut to fit in length.

Once the elongated fastener strip 20 is attached to roof fascia 23 around the perimeter roof line of roof 26, the actual gutter member section installation can begin. The gutter sections are produced in easily handled lengths. Preferred dimensions for each gutter section are three feet long and each would include a two inch overhanging lip 28. Three hooks 18 should be adequate to anchor each gutter section in place. As shown in FIG. 1, one hook is approximately one half inch from the no-lip end of each gutter section, the middle hook eight inches from the overhanging lip end of each gutter section, and another hook three inches from the overhanging lip end of each gutter section.

Further with reference to FIG. 1, the section of gutter 2 which includes a drop outlet leader 12 would be installed first. Generally, this gutter section 2 would be hung exactly as the other sections so that it could be removed in the same lift-off fashion. This gutter section 2 includes a short tube (not shown) which fits into leader 12. The leader 12 itself is affixed to the structure by a metal band 13 including a method of attachment such as screws 15. This section of gutter could also be made permanent; however, a removable downspout gutter section would tend to facilitate easier hose cleaning of the same and of the extending downspout itself thereby helping to prevent downspout clogging due to irregular cleaning. In any case, it would be cut to adjust to the overall length of the gutter system.

As shown in FIG. 1, the next section 4 of the gutter system would then be affixed to elongated fastener strip 20 so that the lip 28 would fit into the gutter channel and on top of the bottom member 6 of the gutter section 2 already in place. The lip 28 is an extension of bottom member 6 and protrudes about two inches away from the present channel into the previous gutter section 2 and its leading edge 29 is beveled in order to enhance water flow and create a tight fit between gutter sections 2 and 4. This tight and precise fitting would assure that no water would drip at the section joints.

The installation would proceed in this way until all gutter sections were in place. A partial end gutter section, shown in FIG. 2, would be added as the last gutter section. This last gutter section would include a standard ending flap 19 on its end opposite the lip overlap. In order to remove the gutter sections, the homeowner would simple reverse the previous installation and lift off each section from the end furthest from the downspout.

Figure 5:
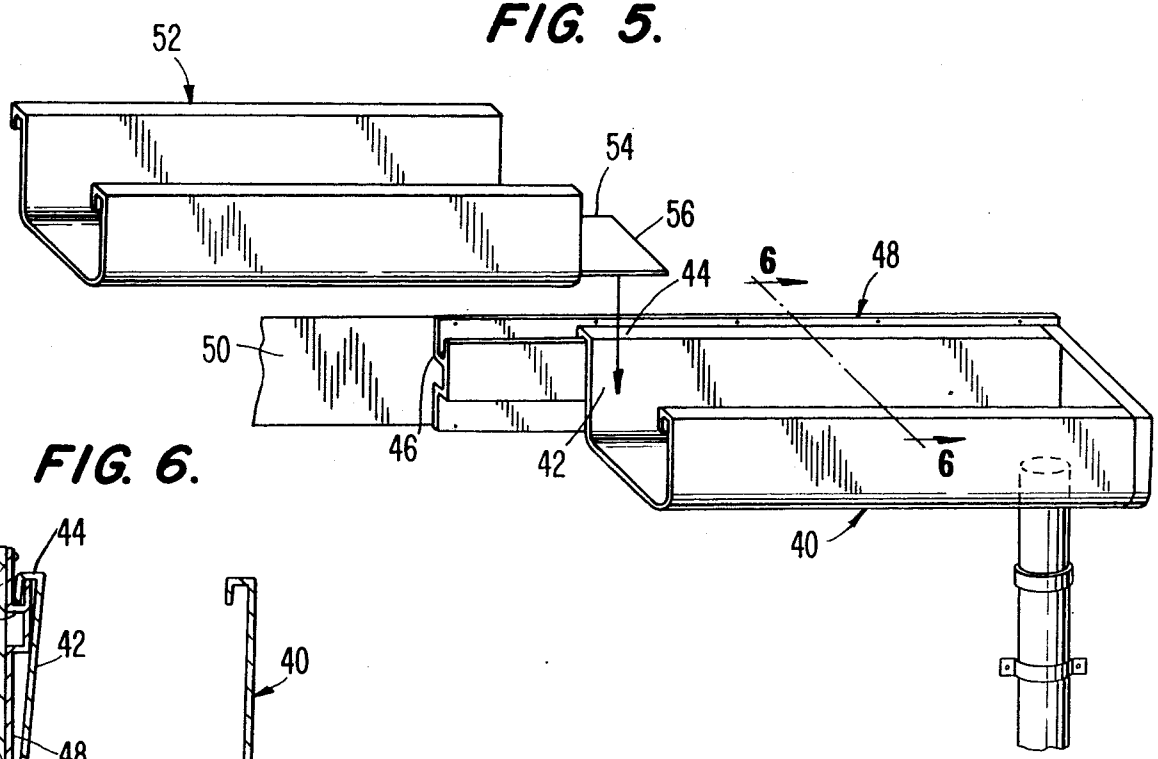
FIG. 5 is a schematic diagram of the dovetail flange embodiment of the removable gutter and fastener system as disclosed by the present invention.
Figure 6:
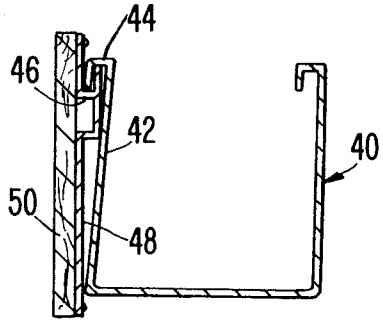
FIG. 6 is a sectional view taken along the line 6—6 of FIG. 5, looking in the direction of the arrows.

Another embodiment of the present invention is shown in FIGS. 5 and 6. This embodiment uses a dovetail flange system for releasably supporting the gutter sections. As shown in FIGS. 5 and 6, gutter section 40 includes a rear wall 42 whose upper edge end is bent into an inverted U-shape 44. This inverted U-shape 44 in turn fits over the U-shape 46 which is formed along the front of fastener strip 48. The elongated fastener strip 48 is about three inches high and nailed permanently to fascia 50 with nails. The U-shape 46 is approximately three quarter inches deep and one half inch wide and is the receptacle for the inverted U-shape 44 formed at the upper edge end of the rear wall 42 of removable gutter section 40.

Figure 7:
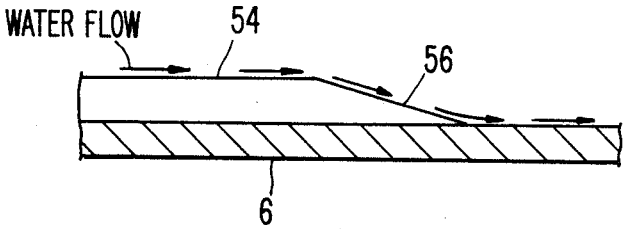
FIG. 7 is a schematic diagram showing the orientation of the beveled lip.

The next gutter section 52 includes a lip 54 which fits tightly into the channel of the previously installed section 40. This lip 54 assures that water will not insinuate itself between the two gutter sections and it adds rigidity to the overall structure. The lip 54 again protrudes about two inches into the previous section 40 and water passage is enhanced through the slight beveling, as shown in FIG. 7, of the leading edge 56 of the protruding lip 54.

In the foregoing specification, this invention has been described with reference to specific exemplary embodiments thereof. It will be evident, however, that various modifications and changes may be made thereunto without departing from the broader spirit and scope of the invention as set forth the appended claims. The specifications and drawings included here are, accordingly, to be regarded in an illustrative rather than in a restrictive sense.

For example, the removable gutter and hanger system disclosed by the present invention could be made of various materials such as aluminum, steel, galvanized metal, plastic, or fiberglass. Of course, since the ease of installation and removal is central to the idea of the present invention, lighter weight materials would be preferable. Furthermore, variously shaped gutter channels are easily usable with both the invention embodiments as herein disclosed.

The gutter section arrangements can also vary immensely depending on the requirements of a particular house roof design For example, a downspout section could be placed anywhere along a series of gutter sections while the connecting gutter sections would interlock in both directions therefrom, with beveled lips extending at the downsloped side of each succeeding gutter section.

End gutter sections could, of course, be added as necessary. Removal would then take place from the high point of each gutter line down towards the lowest gutter section containing the downspout. All sorts of corner and other configurations may be called for and the various designs of the gutter and hanger sections would make virtually any shaped construction possible.

What is claimed is:

1. A removable gutter and fastener system comprising:

at least one elongated detachable roof gutter section three feet in length comprising a substantially flat bottom member, substantially flat front and rear walls attached lengthwise along the bottom member's opposite edges forming a channel therebetween, each flat bottom member terminating at one end in a flat bottomed beveled extending lip approximately two inches in length which helps seal against leakage when inserted into the free end of an adjacent gutter section, said rear wall bearing three hooks along its outer surface, one of said three hooks being located one-half inch from the no lip end of the gutter section, a second of said three hooks being located eight inches from the beveled lip end of the gutter section, and the third of the said three hooks being located three inches from the beveled lip end of the gutter section, a terminating end gutter section comprising a substantially flat bottomed member, substantially flat front and rear walls attached lengthwise along the bottom member's opposite edges forming a channel therebetween, the flat bottom member terminating at one end in a flat bottomed beveled extending lip approximately two inches in length which helps seal against leakage when inserted into the free end of an adjacent gutter section, said terminating end gutter section terminating at its other end with an end flap, said rear wall bearing three hooks along its outer surface, one of said three hooks being located one-half inch from the no end-flap end of the gutter section, a second of said three hooks being located eight inches from the beveled lip end of the gutter section, and the third of the said three hooks being located three inches from the beveled end of the gutter section, an elongated removable downspout gutter section adapted for mating with said roof gutter section and comprising a substantially flat bottom member containing a hole near a first end, substantially flat front and rear walls attached lengthwise along the bottom member's opposite edges forming a channel therebetween, an end flap located at the end near which the said hole is situated, said rear wall bearing three hooks along its outer surface, one of said three hooks being located one-half inch from the no end flap end of the gutter section, a second of said three hooks being located eight inches from the end flap end of the gutter section, and the third of the said three hooks being located three inches from the end flap end of the section, and a downspout section attached to the hole along the bottom member, an elongated fastener strip approximately three inches in height including a plurality of slots spaced therein for releasably securing said hooks, said fastener strip containing hole means to accommodate nails for mounting such fastener strips along the margin the roof of a building.

2. A removable gutter and fastener system in accordance with claim 1 in which said elongated roof gutter section and said elongated fastener strip are composed of plastic.

3. A removable gutter and fastener system in accordance with claim 1 in which said elongated roof gutter section and said elongated fastener strip are composed of metal.

4. A removable gutter and fastener system comprising:

at least one elongated detachable roof gutter section three feet in length comprising a substantially flat bottom member, substantially flat front and rear walls attached lengthwise along the bottom member's opposite edges forming a channel therebetween, each flat bottom member terminating at one end in a flat bottomed two inch beveled extending lip which provides a seal against leakage when inserted into the free end of an adjacent gutter section, said rear wall comprising a flange at its upper end formed in a shape of an upside down U, an elongated removable downspout gutter section adapted for mating with said roof gutter section and comprising a downspout located along its bottom wall, an elongated fastener strip having a front and back side including an elongated flange along its front side formed in a shape of a U for releasably interlocking with the flange of the rear wall of the gutter section, and means for mounting said fastener strip along the margin of the roof of a building.

5. A removable gutter and fastener system in accordance with claim 4 in which said elongated roof gutter section includes an end flap.

6. A removable gutter and fastener system in accordance with claim 4 in which said elongated roof gutter section and said elongated fastener strip are composed of

7. A removable gutter and fastener system in accordance with claim 4 in which said elongated roof gutter section and said elongated fastener strip are composed of metal.

8. A removable gutter and fastener system comprising:

at least one elongated detachable roof gutter section three feet in length comprising a substantially flat bottom member, substantially flat front and rear walls attached lengthwise along the bottom member's opposite edges forming a channel therebetween, each flat bottom member terminating at one end in a flat bottomed extending lip approximately two inches in length which helps seal against leakage when inserted into the free end of an adjacent gutter section, said rear wall bearing three hooks along its outer surface, one of said three hooks being located one-half inch from the no lip end of the gutter section, a second of said three hooks being located eight inches from the lip end of the gutter section, and the third of the said three hooks being located three inches from the lip end of the gutter section, a terminating end gutter section comprising a substantially flat bottomed member, substantially flat front and rear walls attached lengthwise along the bottom member's opposite edges forming a channel therebetween, the flat bottom member terminating at one end in the flat bottomed extending lip approximately two inches in length which provides a seal against leakage when inserted into the free end of an adjacent gutter section, said terminating end gutter section terminating at its other end with an end flap, said rear wall bearing three hooks along its outer surface, one of said three hooks being located one-half inch from the no end-flap end of the gutter section, a second of said three hooks being located eight inches from the lip end of the gutter section, and the third of the said three hooks being located three inches from the end of the gutter section, an elongated removable downspout gutter section adapted for mating with said roof gutter section and comprising a substantially flat bottom member containing a hole near a first end, substantially flat front and rear walls attached lengthwise along the bottom member's opposite edges forming a channel therebetween, an end flap located at the end near which the said hole is situated, said rear wall bearing three hooks along its outer surface, one of said three hooks being located one-half inch from the no end flap end of the gutter section, a second of said three hooks being located eight inches from the end flap end of the gutter section, and the third of the said three hooks being located three inches from the end flap end of the section, and a downspout section attached to the hole along the bottom member, an elongated fastener strip approximately three inches in height including a plurality of slots spaced therein for releasably securing said hooks, said fastener strip containing hole means to accommodate nails for mounting such fastener strips along the margin of the roof of a building.

* * * * *